US005598975A

United States Patent [19]

Jäger

[11] Patent Number: 5,598,975

[45] Date of Patent: Feb. 4, 1997

[54] ROTOR NOZZLE, ESPECIALLY FOR A HIGH PRESSURE CLEANING APPARATUS

[76] Inventor: Anton Jäger, Krautgartenweg 12, D-89250 Senden, Germany

[21] Appl. No.: 313,469

[22] Filed: Sep. 27, 1994

[30] Foreign Application Priority Data

Sep. 29, 1993 [DE] Germany ..... 43 33 154.8

[51] Int. Cl.[6] ..... B05B 3/04

[52] U.S. Cl. ..... 239/237; 239/240; 239/264

[58] Field of Search ..... 239/237, 240, 239/241, 227, 251, 252, 263.3, 264

[56] References Cited

U.S. PATENT DOCUMENTS

| | | | |
|---|---|---|---|
| 4,073,438 | 2/1978 | Meyer | 239/237 |
| 4,747,544 | 5/1988 | Kränzle | 239/252 |
| 4,989,786 | 2/1991 | Kränzle et al. | 239/240 |
| 5,217,166 | 6/1993 | Schulze et al. | 239/227 |
| 5,265,806 | 11/1993 | Ferrarini | 239/251 |
| 5,328,097 | 7/1994 | Wesch et al. | 239/252 |
| 5,332,155 | 7/1994 | Jager | 239/240 |
| 5,395,053 | 3/1995 | Frech | 239/237 |

FOREIGN PATENT DOCUMENTS

| | | | |
|---|---|---|---|
| 3902478 | 7/1990 | Germany . | |
| 3925284 | 2/1991 | Germany | 239/252 |
| 4013446 | 5/1991 | Germany . | |
| 9108507.1 | 12/1991 | Germany . | |
| 4133973 | 4/1992 | Germany . | |
| 4129026 | 3/1993 | Germany . | |

*Primary Examiner*—Andres Kashnikow
*Assistant Examiner*—Lisa Douglas
*Attorney, Agent, or Firm*—Herbert Dubno; Yuri Kateshov

[57] ABSTRACT

A rotary nozzle for a high pressure cleaning apparatus has a liquid driven rotor inclined to the axis of the rotor housing in which it is received and an O-ring engaging an annular region of the housing to drive the rotor so that it orbits the axis of the housing since either the drive ring or the annular region engaged thereby of the housing for elastically deformable, the speed of the rotor is reduced by deformation work.

17 Claims, 3 Drawing Sheets

ROTOR NOZZLE, ESPECIALLY FOR A HIGH PRESSURE CLEANING APPARATUS

FIELD OF THE INVENTION

The present invention relates to a rotor nozzle, especially for a high pressure cleaning apparatus and, more particularly, to a rotor nozzle of the type in which an inclined nozzle is driven about its axis while its nozzle tip rests in a pocket bearing in the nozzle housing.

BACKGROUND OF THE INVENTION

A rotating nozzle which directs a jet in a rotational path about the axis of a nozzle housing and having a rotor within this housing which can rotate the nozzle body about the axis, driven by the liquid which is dispensed therethrough, has been described interalia in my U.S. Pat. No. 5,332,155, the literature described therein and the literature cited in the file of that patent.

Another rotor nozzle is described, for example, in German Patent Document DE 39 02 478. In all of these nozzles the geometry and structure of the assembly determines the rotary speed of the nozzle and frequently it is desirable to reduce the rotational speed of the rotor member within the nozzle housing.

OBJECTS OF THE INVENTION

It is therefore the principal object of the present invention to provide an improved rotor nozzle which allows in a relatively simple manner a reduction in the speed of the rotor about the longitudinal axis of the nozzle.

Another object is the invention is to provide a rotor nozzle which utilizes advantages of prior art nozzles and particularly that of DE 39 02 478 while nevertheless enabling in a simple manner a reduction in the rotor speed thereof.

It is also an object of this invention to provide an improved rotor nozzle which is free from drawbacks of earlier nozzles.

SUMMARY OF THE INVENTION

These objects and others which will become apparent hereinafter are attained, in accordance with the invention, by providing within the nozzle housing at the inlet side thereof a vortex chamber which communicates with the inlet end of the rotor which is provided with drive fins which induce rotation of that rotor about its longitudinal axis and the axis of the bore terminating in an orifice at the opposite end of the rotor body which is received in the pocket bearing, the rotation of the rotor body about its axis causing the rotor body to orbit the longitudinal axis of the nozzle housing. According to the invention, moreover, the housing wall is provided with an annular ring region which is engaged by a rolling ring on the rotor body so that, as this roller ring rotates in engagement with the annular region of the housing, the rotor body is driven in its orbiting motion. An important feature of the invention is that at least one of the two drivingly engageable members, namely, the drive ring provided on the rotor body and the annular region engaged thereby, are elastically deformable. The liquid feed to the inlet region formed as a vortex chamber can be effected at least in part through radial bores at the inlet portion of the device.

The advantage obtained with the system of the invention, namely, the elastic configuration of one or both of the drive parts of the rotor and the housing which engage one another to induce orbiting as the rotor is rotated about its axis by the fins acted upon by the liquid, is a reduction in the speed of the rotor because of the deformation work resulting from elastic deformation of one or both of the mutually engaged drive parts.

In a preferred embodiment of the invention, the annular region forming the drive part of the housing has axially extending profiles either in the form of ribs or bumps or like projections which can be uniformly distributed over the circumference of the annular region.

The rolling ring, i.e. the drive part of the rotor body, is advantageously formed as an O-ring.

According to a feature of the invention, the rotor can be provided with two axially offset and mutually coaxial drive rings which engage the annular region. Depending upon the configuration of the annular ring on the inner wall of the housing, the rings can have the same or different diameters. The wall of the housing or the annular region may be cylindrical or frustoconical. In either case, where two rings are provided, the two rings should engage the annular region at different distances from the axis of the rotor body, thereby inducing a friction effect similar to that which obtains when two wheels of a vehicle are not differentially connected but are fixed on a axle and the vehicle negotiates a curve.

Advantageously, the drive ring can be received in a groove of a bearing ring rotationally mounted on the rotor. It is also possible in accordance with the invention to provide the bearing ring between a drive sleeve carrying the fins and fixed to the rotor body at the inlet end thereof and an axially shiftable clamping sleeve which is rotatable on the rotor body. By a corresponding dimensioning of the components in automatic speed regulation can be achieved since the clamping sleeve can press against the bearing ring with a force proportional to the centrifugal force, thereby applying to the roller ring an additional frictional force.

According to another feature of the invention, at the inlet side of the housing the liquid distributor can be formed with an internal conical surface which is spaced slightly from the inlet end of the rotor body. Best results are obtainable when, between this end of the rotor and the inner conical surface a gap between 0.1 and 2 mm and preferably 0.2 and 1 mm in width is formed. With this narrow gap, an adequate calming of the turbulent liquid is achieved as it enters the rotor body.

The inner conical surface can surround a centrally surrounding boss which can maintain the desired inclined orientation of the rotor.

According to yet another feature of the invention, the cup bearing in which the outlet end of the rotor is received is so supported that it is spring loaded and can move against the spring loading in the direction of the outlet orifice.

More specifically, the rotor nozzle assembly for the invention can comprise:

- a nozzle housing having a longitudinal axis, a central inlet formed at one end of the housing, and an outlet at an opposite end of the housing for discharging a jet of a cleaning liquid;
- an elongated rotor in the housing having a throughgoing passage receiving the liquid at an end proximal to the inlet and discharging the liquid at an end proximal to the outlet and formed with an orifice producing the jet;
- a pocket bearing receiving the end of the rotor proximal to the outlet and enabling orbiting of the rotor about the longitudinal axis;
- means for rotating the rotor about a rotor axis inclined to the longitudinal axis;

a radially outwardly projecting drive ring member on the rotor; and means forming an annular drive-region member on the housing frictionally engaged by the drive ring member to orbit the rotor about the longitudinal axis, at least one of the members being elastically deformable.

Preferably the region of the housing turned toward the inlet region is formed as a vortex chamber and the cleaning liquid is delivered thereto by at least partially radial passages opening into this region.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
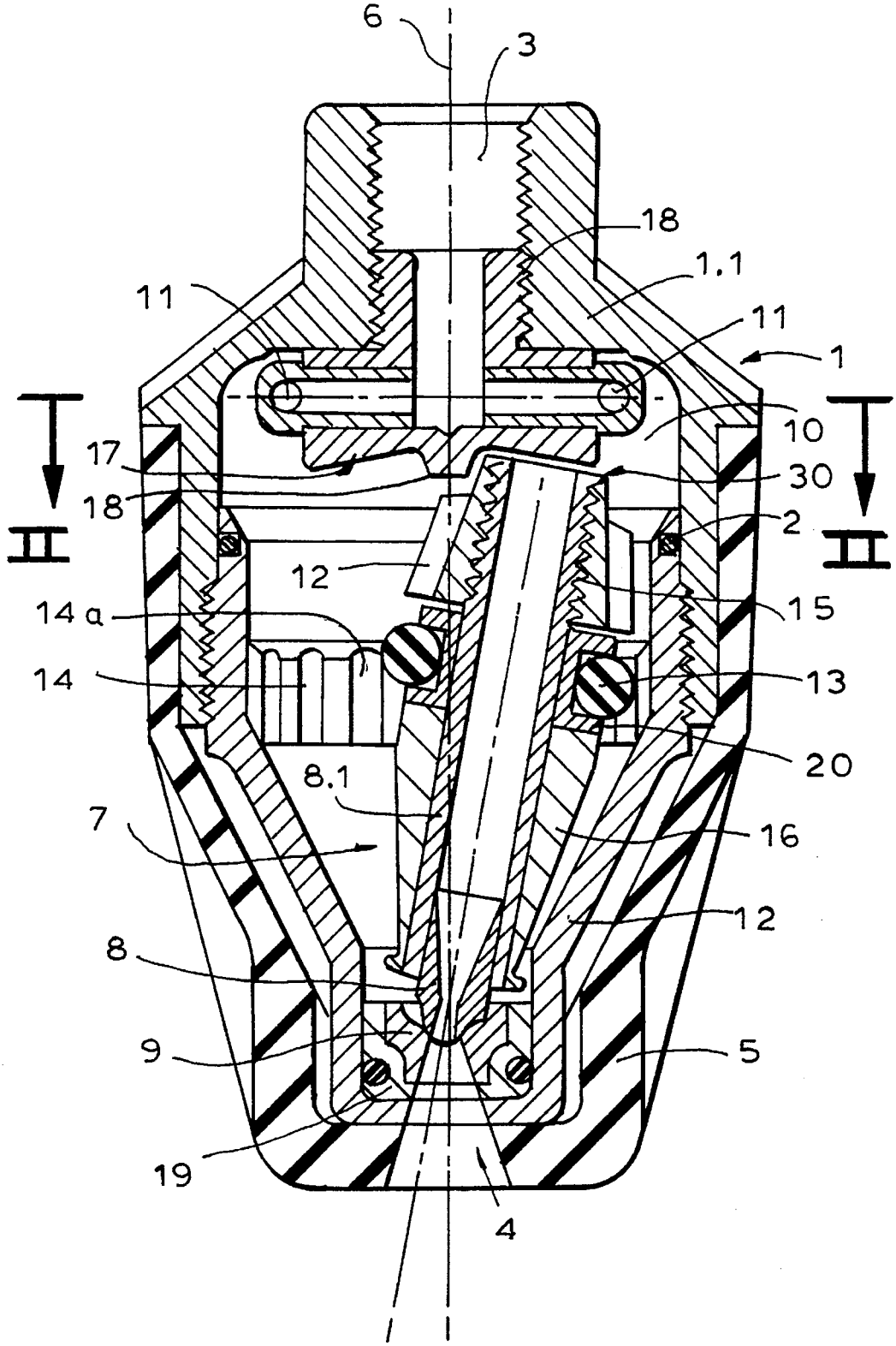
FIG. 1 is a diagrammatic axial cross sectional view through a rotor nozzle according to the invention.

The rotary nozzle assembly of the invention is used especially in a high pressure cleaning apparatus for the nozzle at the end of a pistol grip or wand connected by a hose to a high pressure pump. The nozzle as illustrated in FIG. 1 comprises parts 1.1 and 1.2 are connected together by a screwthread and are sealed by an O-ring 2.

The nozzle housing 1 is provided at one axial end with a central inlet opening 3 and at the opposite axial end with an outlet opening for discharging the cleaning liquid in the form of a jet which orbits around the axis of the housing.

Along the housing at least at its side turned toward the outlet opening 4, a rubber cap 5 is provided on the housing 1.

Within the housing 1 a rotor 7, inclined to the longitudinal axis 6 of the housing is provided and is frictionally engaged with the inner wall of the housing so that as the rotor 7 is driven about on its axis, its ability to roll against the wall of the housing will cause the rotor to orbit the axis 6. The rotor 7 has a throughgoing passage traversed by the cleaning liquid and forming a nozzle along the axis of the rotor.

The end of the nozzle 8 or a nozzle body toward the outlet opening is swivelable in a pocket bearing 9.

Figure 2:
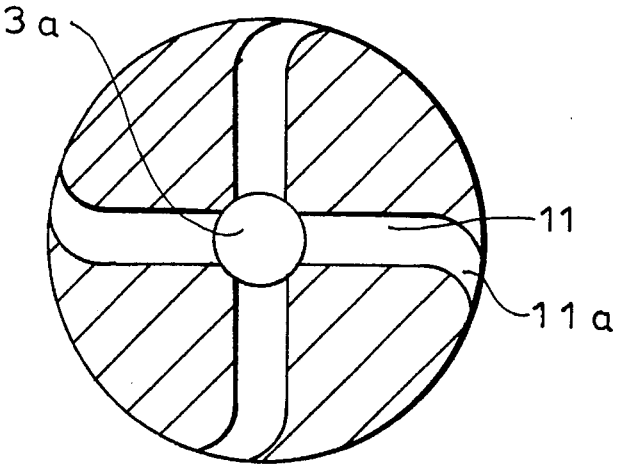
FIG. 2 is a section through the legal inlet distributor taken along the line II—II of FIG. 1.

The region of the housing turned toward the inlet opening 3 is formed as a vortex chamber 10 into which a plurality of radial inlet passages 11 can open from the central bore 3*a* as shown in FIG. 2. The passages 11 can have tangential mouthes 11*a* to impart a tangential component to the flow entering the vortex chamber (FIG. 2).

Figure 5:
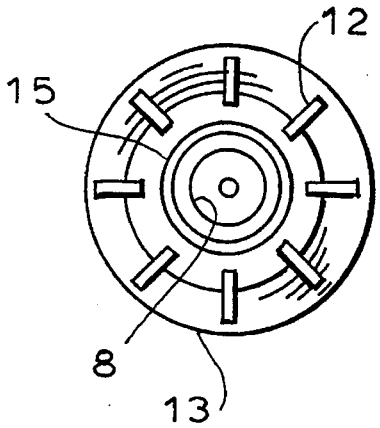
FIG. 5 is an end view of the rotor showing the fins thereon.
Figure 4:
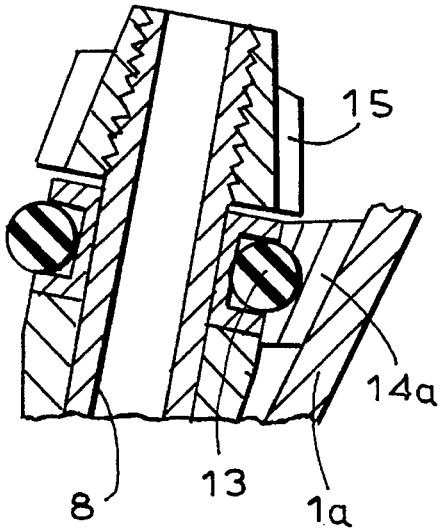
FIG. 4 is a view similar to FIG. 3 of another modification.

The rotor 7 is provided in the region of the vortex chamber with drive vanes or fins 12 (see FIGS. 1 and 5). Furthermore, the rotor has a radially outwardly projecting rolling or drive ring 13 which engages the cylindrical annular region 14 of the housing wall. That region can be conical as shown at 14*a* in FIGS. 4.

The annular region 14 is advantageously provided with axially extending profile, i.e. circumferentially equispaced ribs or bulges or other projections as represented at 14*a* in FIG. 1.

The drive ring 13 and/or the annular region 14 are elastic so that as the ring 13 rides on the annular region 14, there is some deformation of one or both elastic members and hence a reduction in the speed of the rotor resulting from the deformation work. As can be seen in FIG. 1, the drive ring 13 can be an O-ring.

Figure 3:
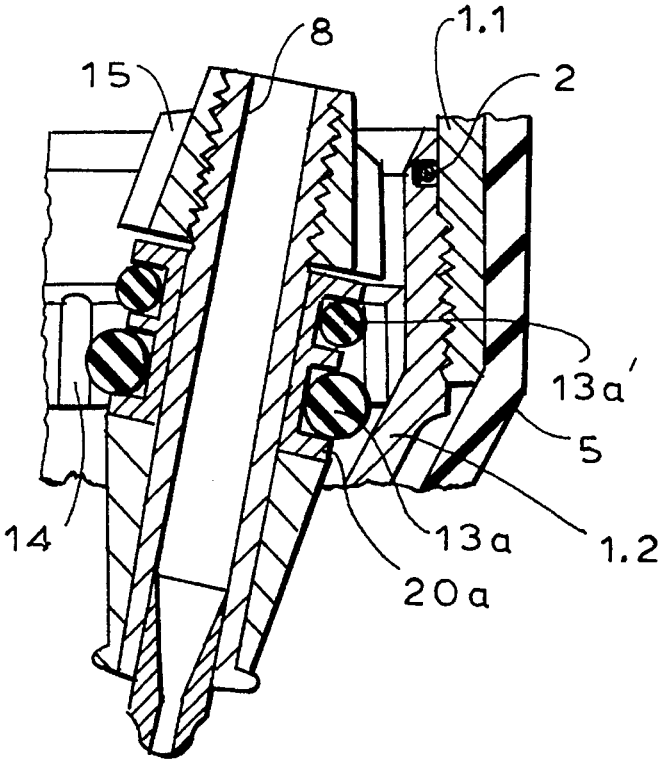
FIG. 3 is a fragmentary section showing a portion of the nozzle modified to have two drive rings.

As can be seen from FIG. 3, the rotor can have 2 axially spaced rings 13*a*, 13*a*', both of which engage the annular region 14. These rings can be of different diameters if the annular region 14 is cylindrical or of the same diameter as the annular region is conical. The effect of the two rings on the single rotating body is similar to the effect of two wheels on a rigid axle of a motor vehicle in negotiating a turn in increasing the frictional retardation the speed of the rotor.

As can be seen from FIG. 1, the drive ring 13 is received in a groove of a bearing ring 20 which is rotatable on the rotor 7. The bearing ring 20 20*a* is disposed between a drive sleeve 15 provided with the vanes 12 and affixed to the rotor body 7 or the nozzle body 8.1 and an axially shiftable and rotatable clamping sleeve 16 on the nozzle body 8.1. When the rotor 7 is driven by the vanes, the centrifugal force with increasing speed will cause the clamping sleeve 16 to press the bearing ring 20 which will provide additional friction work and afford an automatic speed control.

At the inlet side of the housing 1, and internal conical surface 17 is provided around a central projection or boss 18 which maintains the inclination of the rotor.

The inlet end of the rotor 7 is spaced only minimally from the internal conical surface so that the cleaning liquid is calmed in the region at which it enters the nozzle body 8.1. The gap 30 between the rotor and the internal conical surface 17 has a width of 0.1 to 2 mm and preferably between 0.2 and 1 mm.

Figure 6:
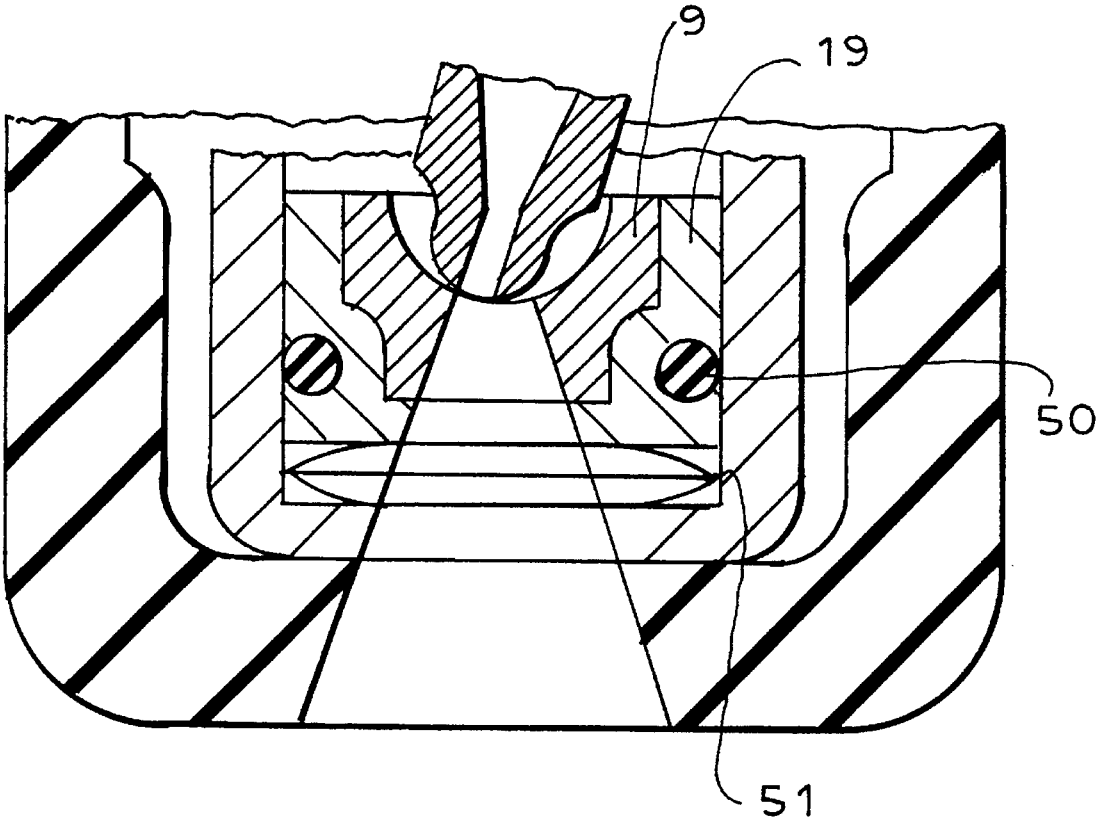
FIG. 6 is a detail view of the pocket bearing showing the spring loading thereof.

The pocket bearing 9 is received in a holder 19 (FIG. 6) which can be sealed with an O-ring 50 and is pressed by a dashed disk spring 51 formed by a stack of belville washers, thereby insuring that the bearing 9 will rest against the nozzle 8 even in the absence of pressurization in the housing 1. This insures an impact free and thus reduced wear operation of the rotor under pressure.

I claim:

1. A rotor nozzle assembly for a high-pressure cleaning apparatus, comprising:

a nozzle housing having a longitudinal axis, a central inlet formed at one end of said nozzle housing, and an outlet at an opposite end of said nozzle housing for discharging a jet of a cleaning liquid;

an elongated rotor in said nozzle housing having a throughgoing passage receiving said cleaning liquid at an end proximal to said inlet and discharging said cleaning liquid at an end proximal to said outlet and formed with an orifice producing said jet;

a pocket bearing receiving said end of said rotor proximal to said outlet and enabling orbiting of said rotor about said longitudinal axis;

means for rotating said rotor about a rotor axis inclined to said longitudinal axis;

a radially outwardly projecting drive ring member on said rotor, said drive ring member including bearing ring mounted rotatably on said rotor and formed with a groove open radially outwardly, and a drive ring received in said groove; and means forming an annular drive-region member on said housing frictionally engaged by said drive ring member to orbit said rotor about said longitudinal axis, at least one of said drive-region and drive ring members being elastically deformable.

2. The assembly defined in claim 1 wherein said housing is formed with a vortex region communicating with said inlet and said inlet includes at least in part radial passages communicating with said vortex region.

3. The assembly defined in claim 2 wherein said drive region member is of cylindrical configuration.

4. The assembly defined in claim 2 wherein said drive region member is of conical configuration.

5. The assembly defined in claim 2 wherein said drive region member is a drive region of a wall of said nozzle housing formed with profiling extending in an axial direction.

6. The assembly defined in claim 5 wherein said profiling is ribs uniformly distributed over a circumference of said drive region member.

7. The assembly defined in claim 5 wherein said profiling is projections uniformly distributed over a circumference of said drive region member.

8. The assembly defined in claim 2 wherein said drive ring member is an O-ring.

9. The assembly defined in claim 2 wherein said drive ring member comprises two axially offset drive rings both of which engage said drive region member.

10. The assembly defined in claim 9 wherein said drive rings are of the same diameter.

11. The assembly defined in claim 9 wherein said drive rings are of different diameters.

12. The assembly defined in claim 2, further comprising a bearing holder receiving said bearing and means applying a spring force to said bearing holder countering movement of said bearing toward said outlet.

13. The assembly defined in claim 1 wherein said bearing ring is received on a body of said rotor between a drive sleeve provided with propelling fins and fixed to said body, and a clamping sleeve rotatable on said body and axially shiftable thereon.

14. The assembly defined in claim 2 wherein said nozzle housing is formed with an inner conical surface spaced from said end of said rotor proximal to said inlet, said end of said rotor being spaced from said inlet with a small spacing.

15. The assembly defined in claim 14 wherein said spacing is between 0.1 and 2 mm.

16. The assembly defined in claim 15 wherein said spacing is between 0.2 and 1 mm.

17. The assembly defined in claim 14 wherein said inner conical surface surrounds a central boss maintaining an inclined orientation of said rotor.

* * * * *